United States Patent [19]

Fischer

[11] 4,403,588

[45] Sep. 13, 1983

[54] FUEL INJECTION SYSTEM FOR OTTO ENGINES

[75] Inventor: Dietrich Fischer, Berglen, Fed. Rep. of Germany

[73] Assignee: Daimler-Benz AG, Stuttgart, Fed. Rep. of Germany

[21] Appl. No.: 274,187

[22] Filed: Jun. 16, 1981

[30] Foreign Application Priority Data

Jun. 18, 1980 [DE] Fed. Rep. of Germany ..... 3022632

[51] Int. Cl.³ ..... F02M 21/02

[52] U.S. Cl. ..... 123/525; 123/455; 123/276

[58] Field of Search ..... 123/525, 527, 452, 453, 123/455, 276 E

[56] References Cited

U.S. PATENT DOCUMENTS

| | | | |
|---|---|---|---|
| 3,713,430 | 1/1973 | Knapp et al. | 123/455 |
| 4,068,639 | 1/1978 | Cook | 123/525 |
| 4,096,838 | 6/1978 | Tanaka et al. | 123/453 |
| 4,108,117 | 8/1978 | Stumpp et al. | 123/452 |
| 4,132,211 | 1/1979 | Wilfert et al. | 123/453 |

*Primary Examiner*—Charles J. Myhre
*Assistant Examiner*—E. Rollins Cross
*Attorney, Agent, or Firm*—Craig & Burns

[57] ABSTRACT

A fuel injection system for an Otto engine having a mixture-control unit provided with an air flow sensor and a fuel distributor. The fuel injection system may be switched from service with a gasoline-operated engine to service with a gas-operated engine and, in the process, the sensor plate of the air flow sensor is opened as well as blocked in the open position with a gas-operated engine.

11 Claims, 2 Drawing Figures

FUEL INJECTION SYSTEM FOR OTTO ENGINES

The present invention relates to an injection system, and more particularly, to a fuel injection system for Otto engines having a mixture control means provided with an air flow sensor and a fuel distributor.

A fuel injection system of the aforementioned type is disclosed in, for example, Bosch "Technische Unterrichtung, Benzineinspritzung, K-Jetronic" (Technical Instruction, Gasoline Injection, K-Jetronic) VDT-UBP 741/1.

The aim underlying the present invention essentially resides in providing a fuel injection system which may be easily switched from service with gasoline-operated engine to service with a gas operated engine.

In accordance with advantageous features of the present invention, a system is proposed which is adapted to be switched from a gasoline operation to a gas operation and, in the process, to open as well as to block a sensor plate of an air flow sensor in the switched condition.

Since a vacuum exists in motor vehicles, advantageously, such vacuum may be employed to assist in the changeover from gasoline operation to gas-operation. In accordance with the present invention, the sensor plate of an air flow sensor is opened and blocked by means of a control pin which is pushed forward against a control lever through a vacuum means.

Advantageously, the vacuum means is constructed as a double acting vacuum element which, on one side, may be charged or acted upon by a vacuum originating in the intake manifold and, on the other side, acted upon by an atmospheric pressure.

It is also possible in accordance with the present invention, to employ a vacuum element which may be pressure loaded with vacuum on one side only, with a spring or solenoid being used to return the vacuum element to a neutral position.

With double-acting vacuum elements, in accordance with further features of the present invention, two tubes may be connected which branch off to two valves disposed in parallel, namely, a four/two-way valve and a three/two-way valve. In these circumstances, the first valve, that is, the four/two-way valve, may connect the two connection tubes to a "vacuum" and to "atmosphere", while the other valve, namely, the three/two-way valve, establishes a connection to "atmosphere" and to a "closed" or blocked position. The valves are connected such that, when switching from service with a gasoline operated engine to service with a gas operated engine, the two valve ports "vacuum" and "atmosphere" or "atmosphere" and "closed" are interchanged. Advantageously, in accordance with further features of the present invention, a fuel distributor is provided, which includes a mechanism constructed such that for service with a gasoline-operated engine, the chamber of the vacuum element turned or facing the control lever is charged or acted upon by a vacuum, while for service with a gas-operated engine, the other chamber is pressurized therewith. By virtue of this arrangement, in the former case, i.e., a gasoline-operation, a control pin acting upon a two-armed control lever is withdrawn so far therefrom that the latter may make, without any impediments, control movements in accordance with regulations of the mixture-control unit, while, in the latter case, i.e., a gas-operation, the control pin is pressed against the control lever so that the latter may be swung into a position wherein it strikes a stop and, in which position, the sensor plate located on the end of the control lever fully opens a corresponding air funnel.

With an intake manifold pressure being minimal or in situations where there is not intake manifold pressure such as, for example, when the engine is running at a full load, the position of the vacuum element which, of necessity, must be stable, may easily become unstable. To prevent this, in accordance with further features of the present invention, a check valve is disposed in a tube leading from a chamber facing away from the control lever to the first valve, that is, the four/two-way valve, downstream to a branching point to the other valve, that is, the three/two-way valve. The check valve is inserted in such a manner and has a direction of operation so that it opens during an evacuation of the chamber facing away from the control lever.

Accordingly, it is an object of the present invention to provide a fuel injection system for an Otto engine which avoids, by simple means, shortcomings and disadvantages encountered in the prior art.

Another object of the present invention resides in providing a fuel injection system for an Otto engine which is simple in construction and therefore relatively inexpensive to manufacture.

A still further object of the present invention resides in providing a fuel injection system for an Otto engine which may be readily switched from a gasoline operation to a gas operation.

A still further object of the present invention resides in providing a fuel injection system for Otto engines which functions realiably under all load conditions of the engine.

These and other objects, features, and advantages of the present invention will become more apparent from the following description when taken in connection with the accompanying drawing, which shows, for the purpose of illustration only, one embodiment in accordance with the present invention, and wherein.

Figure 1:
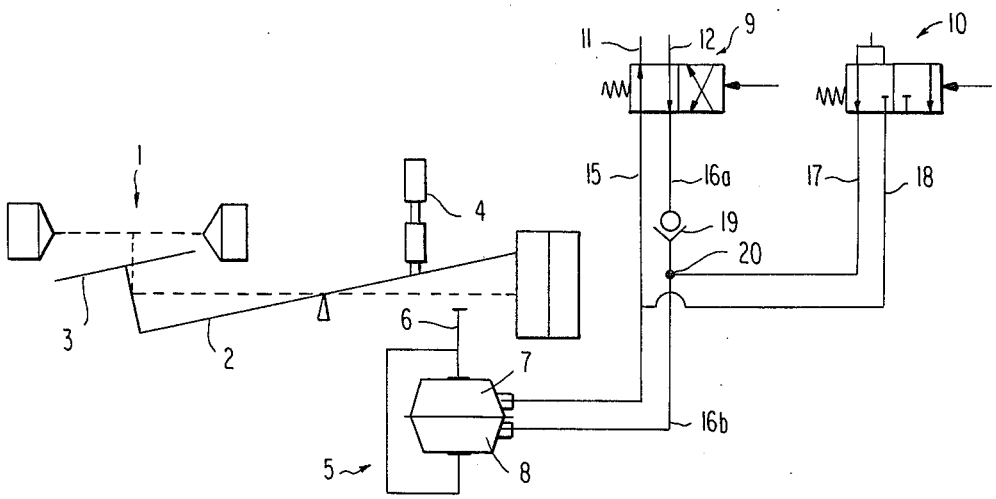
FIG. 1 is a schematic view of a fuel injection system constructed in accordance with the present invention with an operating pin withdrawn from a control lever for a gasoline operation of an engine.

Referring now to the drawings wherein like reference numerals are used in both views to designate like parts and, more particularly, to FIG. 1, according to this Figure, a fuel injection system is provided which includes an air flow sensor means generally designated by the reference numeral 1 and a two-arm control lever 2 supporting a sensor plate 3 on one side, which sensor plate 3 is adapted to open and close the air flow sensor 1. A second lever arm of the two-arm control lever 2 operates a control plunger 4 of a fuel distributor. A double-acting vacuum element generally designated by the reference numeral 5 is disposed beneath the second arm of the two-arm control lever 2. The double acting vacuum element 5 includes a control lever 6 cooperable with the second arm of the control lever 2. The vacuum element 5 includes two chambers 7, 8 which may be charged alternatively and reciprocably with vacuum or with atmospheric pressure.

As shown in FIG. 1, the upper chamber 7 faces the control lever 2, and the upper chamber 7 is acted upon by a vacuum when the chamber 8, facing away from the control lever 2, is exposed to atmospheric pressure so as to cause the control pin 6 to be withdrawn from the control lever 2 so that the control lever 2, as is necessary for a gasoline-operation of an engine, may be swung within a working range provided from a fully opened to a fully closed position with respect to the air flow sensor 1.

Figure 2:
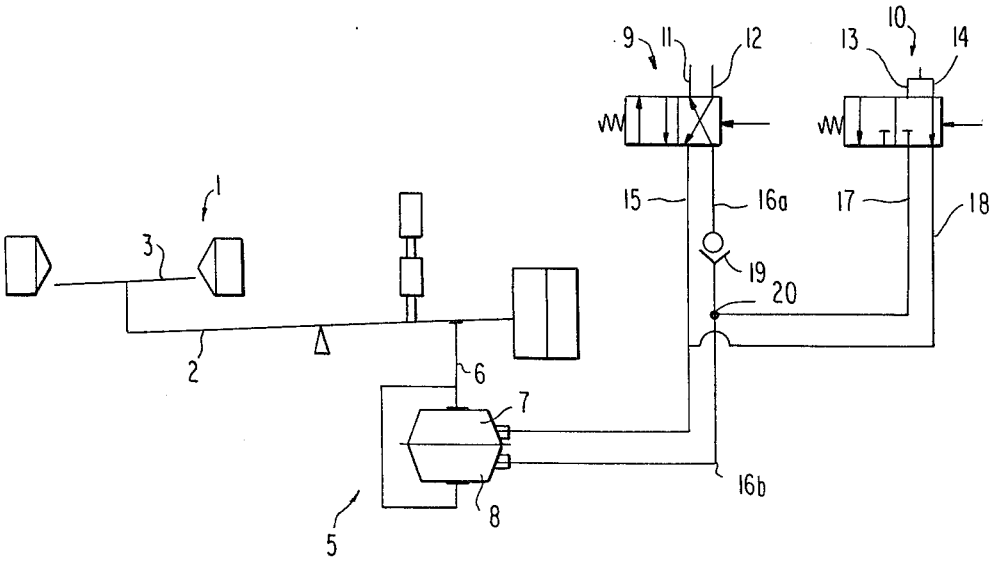
FIG. 2 is a schematic representation of the fuel injection system of FIG. 1 with the operating lever being displaced forwardly against the control lever so that the operating pin opens a sensor plate of an air flow sensor and locks the same in the position for enabling a gas-operated service of an engine.

As shown in FIG. 2, the chamber 7, facing the control lever 2, is charged with an atmospheric pressure and the chamber 8, facing away from the control lever 2, is charged with a vacuum so that the control lever 6 is pushed forward against the control lever 2, whereby the control lever 2 is swung to an extreme position and is locked therein. In the extreme position, the sensor plate 3 is fully open with respect to the air flow sensor 1 the position of the control lever 2 and sensor plate 3 is necessary for a gas-operation of the engine.

In order to effect a changeover of the vacuum element 5, two valve means are provided. One of the valve means is constructed as a four/two-way valve generally designated by the reference numeral 9, with the other valve means being constructed as a three/two-way valve generally designated by the reference numeral 10. Discharge lines 11, 12 are connected to the valve 9, with the discharge line 11 being connected with a vacuum and the line 12 being connected with atmospheric pressure. The valve 10 is provided with discharge lines 13, 14 both of which are connected with the atmosphere. The valves 9, 10 are provided with additional ports to which are respectively connected conduits or lines 15, **16*a*, 17, 18. The conduit 18 leads to the chamber 7 with the conduit 16 leading to the chamber 8. The conduit 17 is connected with the conduit 16 and the conduit 18 is connected with the conduit 15. A check valve 19 is interposed in the conduit 16 which leads from the chamber 8 to the four/two-way valve 9. Check valve 19 is disposed downstream of a branching or connecting point 20 between the conduit 16 and the line 16*a*. The check valve 19 is adapted to open when the pressure in the conduit 16*a*, facing the valve 9, is lower than a pressure in a conduit or line section 16*b* which faces the chamber 8 of the vacuum element 5**.

During a normal service, that is, when the engine is to run on gasoline, the four/two-way valve 9 is connected, as shown most clearly in FIG. 1, so that the chamber 7 of the vacuum element is acted upon by an intake manifold vacuum through the conduits 11 and 15. The check valve 19 is closed and the chamber 8 is charged or acted upon by an atmospheric pressure through the conduits **16*b*, 17, and the three/two-way valve 10. During this stage of pressurization of the vacuum element 5, the control pin 6 is withdrawn from the two-arm control lever 2 so that the air flow sensor 1 may act without any impediments on the control piston 4** of the fuel distributor.

For service with a gas-operation of the engine, both the valves 9 and 10 are switched to the position illustrated in FIG. 2 and, in this manner, an intake manifold vacuum is applied to the chamber 8 of the vacuum element 6 through the valve 9 and conduit **16*a* and 16*b* so as to cause the check valve 19 to open. The conduit 17 is closed through the three/two-way valve 10 and the chamber 7 is connected with the atmosphere through the conduits 15 and 18 and valves 9 and 10. This displacement of the valves 9, 10 results in the control pin 6 being pushed forward against the control lever 2 so as to lock the same into the open position of the sensor plate 3 illustrated in FIG. 2** so that the air flow sensor remains fully open for a duration of the service with a gas-operation.

The check valve 19 is provided so as to prevent an instability in area wherein there is a minimal intake-manifold vacuum of no vacuum at all such as, for example, when the engine is running at full load. Moreover, the provision of the check valve 19 prevents the control pin 6 from being withdrawn when the engine backfires which could result in a closing of damage to the air flow sensor 1.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A mechanism for the selective operation of Otto engines by means of gaseous and liquid fuels having a throttling member, that can be blocked by a pin, and a double-acting vacuum element which, on the one hand, can be acted upon by vacuum coming from an intake pipe and, on the other hand, by atmospheric pressure, characterized in that the mechanism is intended for a fuel-injection system having mixture controls, and comprises an air meter and a fuel-volume divider means, where the pin can be adjusted by means of a vacuum element;

two duct means are connected to the vacuum element; and the pair of duct means branches into two respective pairs of ducts which are parallel to one another, where one pair of ducts is connected with a 4/2-way valve means, and the other pair of ducts is connected with a 3/2-way valve means.

2. A mechanism according to claim 1, characterized in that the first 4/2-way valve means provides the connection from the two connecting ducts to "vacuum" and "atmosphere", and the other 3/2-way valve means provides the connection from the two connecting ducts to "atmosphere" and to "closed".

3. A mechanism according to claim 1, characterized in that a check valve means that opens during evacuation in the gas operation of the engine, is disposed in the duct between the branching point of the duct and the 4/2-way valve.

4. A fuel injection system according to claim 3, characterized in that the intake pipe is an intake manifold of the engine and serves as a vacuum source.

5. A fuel injection system according to claim 3, characterized in that the connecting ducts include pressure conduit means arranged between the respective chambers and at least one of the valve means, and in that the conduit means for one of the valve means branches off from the conduit means for the other one of the valve means.

6. A fuel injection system according to claim 5, characterized in that during a switch from gasoline-operation to gas-operation the connections of the respective valve means are interchanged.

7. A fuel injection system according to one of claims 5 or 6, wherein is provided control lever means for responding to sensed air flow, characterized in that the first pressure chamber is arranged on a side of the vacuum element facing the control lever means, and in that the first pressure chamber is connected to the vacuum source for the gasoline operation and the second chamber is connected with the vacuum source for the gas operation.

8. A fuel injection system according to claim 7, wherein is provided a control pin means for cooperating with the control lever means and characterized in that means are provided for preventing an instability in an operation of the control pin means at one of a minimum vacuum from the vacuum source.

9. A fuel injection system according to claim 8, characterized in that the second pressure chamber is disposed on a side of the vacuum element facing away from the control lever means, the check valve means is arranged in the duct means between the second pressure chamber and one of the valve means at a position downstream of the branching off of the duct means for the other valve means, and in that the check valve means opens when the second pressure chamber is subject to a vacuum.

10. A fuel injection system according to one of claims 3 or 5, wherein is provided control lever means for responding to sensed air flow and control pin means for cooperating with the control lever means and characterized in that means are provided for preventing an instability in an operation of the control pin means at one of a minimum vacuum or no vacuum from the vacuum source.

11. A fuel injection system according to claim 10, characterized in that the means for preventing instability comprises at least said check valve means disposed between one of the pressure chambers and one of the valves.

* * * * *